US005119049A

United States Patent [19]

Heller et al.

[11] Patent Number: 5,119,049

[45] Date of Patent: Jun. 2, 1992

[54] ULTRAMINIATURE LOW LOSS COAXIAL DELAY LINE

[75] Inventors: Paul Heller, Dix Hills; John A. Pierro, East Meadow; Thomas H. Graham, Lindenhurst; Scott M. Weiner, Wantagh, all of N.Y.

[73] Assignee: Ail Systems, Inc., Deer Park, N.Y.

[21] Appl. No.: 685,375

[22] Filed: Apr. 12, 1991

[51] Int. Cl.[5] ..... H01P 3/08; H01P 9/00

[52] U.S. Cl. ..... 333/160; 333/156; 333/222

[58] Field of Search ..... 333/160, 156, 159, 161, 333/141, 206, 207, 219, 222, 243, 260

[56] References Cited

U.S. PATENT DOCUMENTS 3,781,722 12/1973 Pierson ..... 333/160

4,614,922 9/1986 Bauman et al. ..... 333/160

*Primary Examiner*—Eugene R. LaRoche

*Assistant Examiner*—Ali Neyzari

*Attorney, Agent, or Firm*—Hoffmann & Baron

[57] ABSTRACT

An ultraminiature delay line assembly for use with an electronic system. The delay line is utilized for producing and introducing a known controllable time delay to an electrical signal without the accompanying signal attenuation normally associated with traditional coaxial delay lines. The ultraminiature delay line utilizes miniature coaxial transmission cable which is smaller in diameter than the coaxial transmission cable traditionally used. An ultraminiature delay line includes a thin substrate supporting base plate. Mounted on the thin substrate supporting base plate are numerous concentrically wound miniature coaxial cable assemblies. Coupled to the middle of each miniature coaxial cable assembly is a signal amplifying device having variable programmable gain which offsets signal attenuation caused by the length of miniature coaxial cable. Signal switching devices may be included to route the delayed signal from one miniature coaxial cable assembly to another miniature coaxial cable assembly or the delayed signal may be transferred to an output signal connector. Each coaxial cable assembly may be configured to provide different delays. Various combinations of coaxial cable assemblies may be selected to provide various, numerous different total delays.

8 Claims, 4 Drawing Sheets

ULTRAMINIATURE LOW LOSS COAXIAL DELAY LINE

BACKGROUND OF THE INVENTION

1. Field of the Invention

This invention relates generally to electrical delay lines, and more particularly relates to an ultraminiature low loss coaxial delay line for time delaying electrical signals using miniature coaxial cable, amplifiers and switching elements.

2. Description of the Prior Art

Many electronic systems require a controllable time delay element in order to properly process and analyze the electronic signals generated by the system. Typically, time delay of an electronic signal is accomplished by introducing the signal to a coaxial transmission line having a known dielectric, impedance and length. The time delay in seconds of an electronic signal associated with a particular coaxial transmission line is determined by the expression:

$$\text{Time Delay (seconds)} = \frac{[e_r]^{\frac{1}{2}}}{C} \times L$$

where $e_r$=dielectric constant of the coaxial transmission line relative to air L=length of coaxial transmission line in meters C=speed of light in free space in meters/seconds One of the drawbacks to utilizing a coaxial transmission line as a delay line is the resulting electronic signal attenuation. Typically, in order to reduce the amount of electronic signal attenuation produced by a coaxial delay line, delay lines are produced with coaxial transmission lines having relatively large outer diameters. It is well known that signal attenuation can be significantly reduced in this manner because signal attenuation is inversely related to the outer diameter of the coaxial transmission line given a fixed line impedance. Typically, coaxial transmission lines have outer diameters of 0.050 inches to 0.25 inches.

It is also known that the amount of attenuation occurring per 100 feet of coaxial transmission line is given by:

$$A_{100} = 4.34 \frac{R_t}{Z_o} + 2.78\,[f]\,[e_r]^{\frac{1}{2}} Fp$$

where $$R_t = 0.1\left[\frac{1}{d} + \frac{1}{D}\right][f]^{\frac{1}{2}}$$

D=diameter of the inner surface of the outer coaxial conductor in inches d=diameter of the center conductor in inches f=electronic signal frequency in MHz $e_r$=dielectric constant relative to air $F_p$=power factor of the dielectric at a frequency F In light of the above and in order to reduce the amount of signal attenuation, large and heavy coaxial transmission delay lines are traditionally used to obtain a desired electronic signal delay without producing significant unwanted signal attenuation. However, while producing the required time delay without significant signal loss, these traditional delay lines are among the largest and heaviest components of many electronic systems. These bulky and heavy delay lines account for a significant percentage of the size and weight of an electrical system. For example, in order to produce a relatively short 49.7 nsec signal delay with a traditional coaxial delay line, approximately 34.5 feet of RG 142 coaxial transmission cable weighing approximately 1.6 pounds is required.

OBJECTS AND SUMMARY OF THE INVENTION

It is an object of the present invention to provide a coaxial transmission delay line element having an outer diameter and weight that is smaller than those previously used yet can effect relatively long delay times.

It is another object of the present invention to provide a coaxial delay line element which incorporates switchable elements that permit selection of discrete repeatable delays.

It is yet another object of the present invention to provide a coaxial delay line element which utilizes integrated signal amplifying devices to offset any signal loss caused by miniature coaxial transmission cable.

It is yet another object of the present invention to provide a compact, gain and phase equalized ultraminiature coaxial delay line.

It is yet another object of the present invention to provide an ultraminiature coaxial delay line element which overcomes the inherent disadvantages of known miniature coaxial delay lines.

In accordance with one form of the present invention, an ultraminiature low loss coaxial delay line includes at least a thin substrate supporting base plate and a miniature coaxial cable assembly. The ultraminiature low loss microwave delay line is utilized for producing and introducing a known controllable time delay to an electrical signal without the accompanying signal attenuation normally associated with traditional coaxial delay lines.

An ultraminiature low loss coaxial delay line includes one or more closely wound miniature coaxial cable assemblies. The coaxial cable used has a very small diameter which is preferably on the order of 0.025 inches or less. By utilizing a coaxial cable with a very small diameter, the size and weight of the new delay line is reduced compared to the size and weight of traditional delay lines. Each of the closely wound miniature coaxial cable assemblies is flatly mounted on the thin substrate supporting base plate. In a preferred form of the invention, the center of each miniature coaxial cable assembly is an open area. A signal amplifying device is preferably coupled to each miniature coaxial cable assembly and mounted to the thin substrate supporting base plate within the open area in order to provide a compact and space saving arrangement, although it is envisioned to mount the amplifiers in alternate locations on the substrate. Each signal amplifying device compensates for electronic signal attenuation caused by the miniature coaxial cable which is used to make each miniature coaxial cable assembly. Each signal amplifying device is preferably electrically coupled or located to the approximate midpoint of the length of miniature coaxial cable of the closely wound miniature coaxial cable assembly. Each signal amplifying device receives a signal from a portion of the miniature coaxial cable and provides an amplified output signal. Alternatively, additional amplifiers may be uniformly dispersed throughout the length of the delay line to optimize electrical performance.

In another form of the invention, the delay line includes two or more miniature coaxial cable assemblies coupled together by signal switching devices. Each signal switching device is electrically coupled to a previous miniature coaxial cable assembly, a next miniature coaxial cable assembly and an output switch. In this manner, when a signal switching device receives a signal from the previous miniature coaxial cable assembly, the signal switching device can provide the signal from the previous miniature coaxial cable assembly to another coaxial cable assembly in accordance with a control signal received. The control signal corresponds to a total system delay requirement to be produced by the ultraminiature low loss coaxial delay line.

After receiving the delay time signal, the signal switching device can assign the signal from the previous miniature coaxial cable assembly to the next miniature coaxial cable assembly for further time delay. Alternatively, if no additional time delay is required, the signal switching device could route the signal from the previous miniature coaxial cable assembly to the output switch where the signal exits the ultraminiature low loss microwave delay line.

An ultraminiature low loss microwave delay line assembly includes a protective housing which is mounted to or houses the thin substrate supporting base plate. The protective housing covers each closely wound miniature coaxial cable assembly, each signal amplifying device, each signal switching device and the output switch. Attached to the protective housing is an input signal connector, an output signal connector and a power and control signal connector. These connectors are used for communication with components external to the ultraminiature low loss coaxial delay line assembly.

The ultraminiature delay line of the present invention is applicable to all frequency ranges of signals from digital through microwave.

A preferred form of the ultraminiature low loss microwave delay line as well as other embodiments, objects, features and advantages of the invention will be apparent from the following detailed description of illustrative embodiments, which is to be read in connection with the accompanying drawings.

DETAILED DESCRIPTION OF THE PREFERRED EMBODIMENTS

Figure 1:
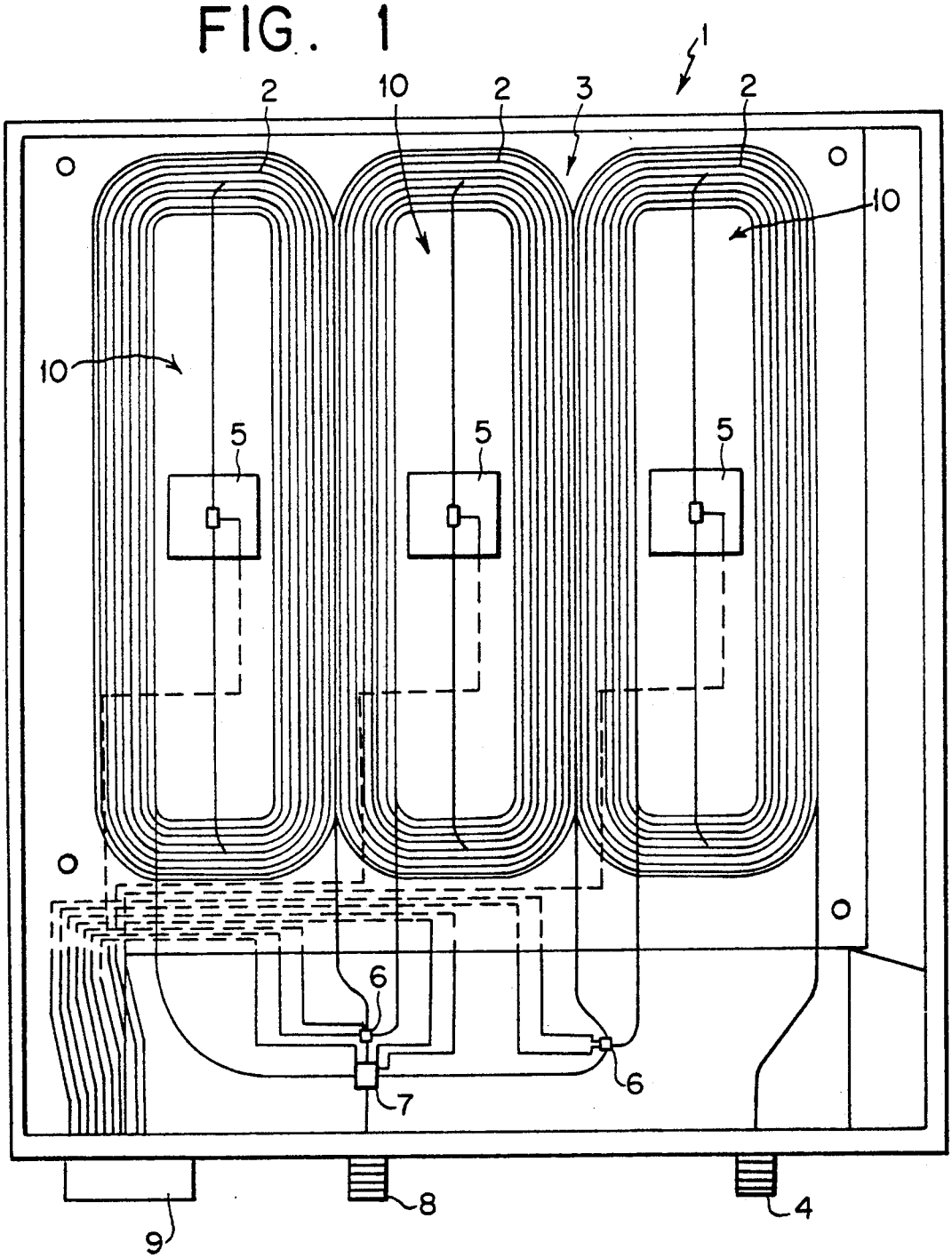
FIG. 1 is a top plan view of one arrangement of the ultraminiature low loss coaxial delay line element in accordance with the present invention.

Referring now to FIG. 1 of the drawings, a preferred form of an ultraminiature low loss coaxial delay line 1 constructed in accordance with the present invention will now be described. The ultraminiature low loss coaxial delay line is designed to provide a known controllable time delay to an electrical signal generated and processed within an electrical system.

The ultraminiature low loss coaxial delay line 1 shown in FIG. 1 basically includes at least one miniature coaxial cable assembly 2 mounted to a thin substrate supporting base plate 3. A first miniature coaxial cable assembly is coupled to an input signal connector 4. Preferably included and located in the center of each miniature coaxial cable assembly and mounted to the thin substrate supporting base plate is a signal amplifying device 5. Each signal amplifying device has its input and output coupled to the approximate midpoint of a length of miniature coaxial transmission cable which is used to make a corresponding miniature coaxial cable assembly. The signal amplifying devices also are coupled to a power and control signal connector 9. The ultraminiature low loss microwave delay line 1 further preferably includes signal switching devices 6 which direct an electronic signal from one miniature coaxial cable assembly to either another coaxial cable assembly for an additional time delay or to an output switch 7. The output switch 7 is coupled to each signal switching device 6 and to an output signal connector 8. Also coupled to each signal switching device 6 and to the output switch 7 is the power and control signal connector 9.

The ultraminiature low loss microwave delay line 1 may consist of any number of miniature coaxial cable assemblies 2. Each miniature coaxial cable assembly 2 is constructed with miniature coaxial cable having a diameter that is preferably on the order of approximately 0.025 inches or less. By utilizing coaxial cable which is on the order of approximately 0.025 inches or less in diameter, a relatively compact and light delay line unit can be produced. Each miniature coaxial cable assembly 2 has an input and an output. In addition, each miniature coaxial cable assembly 2 is preferably constructed by concentrically winding a length of miniature coaxial cable around a previously wound portion of the miniature coaxial cable to produce an elliptical or circular arrangement. This arrangement is advantageous because it allows for a space saving configuration by permitting placement of additional delay line components within an interior open space 10 of the elliptical or circular concentrically wound miniature coaxial cable assembly. The length of the coaxial cable and the number of concentric windings used in forming each miniature coaxial cable assembly may vary according to the delay time required. In order to ensure that the ultraminiature low loss microwave delay line 1 is as compact in height as possible, each concentric winding is closely laid next to the previous windings. Each winding of the miniature coaxial cable assembly is then flatly mounted onto the thin substrate supporting base plate.

The thin substrate supporting base plate on which the windings are mounted may be rigid, or may be flexible to permit the substrate and the windings mounted on it to be folded onto itself, or rolled about itself or onto a central supporting core (not shown) for compactness. As mentioned previously, the windings are affixed to the substrate by an suitable method known in the art, such as by ultrasonic bonding or using an adhesive.

As mentioned previously, the ultraminiature low loss microwave delay line 1 also preferably includes one or more signal amplifying devices 5. Each signal amplifying device 5 is preferably coupled to the approximate midpoint of a corresponding concentrically wound miniature coaxial cable assembly 2. Alternatively, instead of one amplifier situated at the midpoint of the winding, one or more amplifiers may be uniformly distributed throughout the delay line so as to optimize coaxial delay line electrical performance. Each signal amplifying device 5 is designed to compensate for electronic signal attenuation caused by the miniature coaxial cable of each miniature coaxial cable assembly 2. Each signal amplifying device 5 receives a miniature coaxial cable signal as an input signal and provides a signal amplifying device output signal. A suitable signal amplifying device which may be used is Part No. MSA0900 which is a silicon monolithic device produced by Avantek Corporation.

The ultraminiature low loss microwave delay line 1 is configured so that each signal amplifying device 5 will compensate for the signal attenuation caused by the corresponding miniature coaxial cable assembly 2. Therefore, as the length of miniature coaxial cable used changes, the resulting electronic signal attenuation will also vary and the gain of the amplifier should be adjusted accordingly. Ideally, each signal amplifying device 5 should compensate for all signal losses caused by the corresponding miniature coaxial cable assembly 2. Therefore, the delayed signal which exits the miniature coaxial cable assembly 2 should have the same amplitude as the non-delayed signal which entered the miniature coaxial cable assembly 2. In this manner, the output delayed signal is identical to the input non-delayed signal except that the input non-delayed signal has been time delayed by the miniature coaxial cable assembly 2. The gain of the signal amplifying device 5 may be selected to totally offset the signal attenuation caused by the length of miniature coaxial cable over the required design frequency bandwidth.

Figure 2:
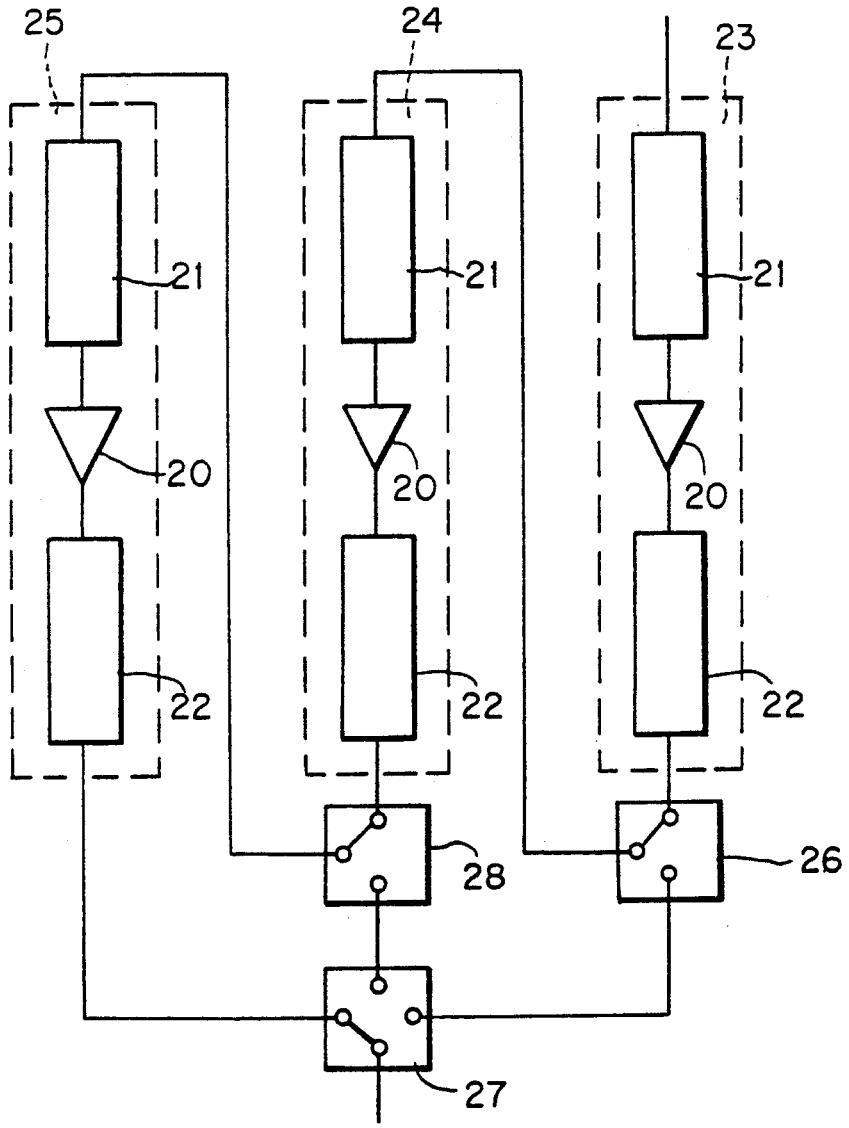
FIG. 2 is functional block diagram of one form of the ultraminiature low loss coaxial delay line element in accordance with the present invention.

Referring now to FIG. 2, a signal amplifying device 20 is preferably located at the approximate cable length midpoint of each delay element assembly 23, 24 and 25. Reference numeral 21 and 22 designate the first and second half portions of miniature coaxial cable which are utilized to form the miniature coaxial cable assembly 2. It has been shown that better signal attenuation offset is obtained by positioning the signal amplifying device 20 near the midpoint of the total length miniature coaxial cable. Therefore, in the preferred embodiment the first and second half portions of miniature coaxial cable 21 and 22 are approximately equal in length.

When the signal amplifying device 20 is placed so that the miniature coaxial cable 22 is significantly greater than the miniature coaxial transmission cable 21, signal amplifying device signal noise may cause increased degradation of the signal provided to the delay element 23. This results in poorer signal attenuation offset by signal amplifying device 20. In addition, since the miniature coaxial cable signal that is provided to the signal amplifying device 20 is not significantly attenuated, a higher power amplifier is required to process the signal. This higher power amplifier can yield more signal amplifying device signal noise causing the signal amplifying device output signal to be attenuated by the signal amplifying device.

It is also not desirable to place the signal amplifying device 20 so that the miniature coaxial cable 21 is significantly greater than the miniature coaxial cable 22 because the miniature coaxial cable signal from miniature coaxial cable 21 may become too attenuated and distorted by the miniature coaxial cable 21. If the miniature coaxial cable signal does become too distorted before reaching the signal amplifying device 20, the signal amplifying device 20 will not be able to accurately regenerate the characteristics of the non-delayed input signal. Therefore, the delayed signal exiting delay element 23 may appear to be significantly different from the non-delayed input signal which was supplied to delay element 23.

Many configurations of signal amplifying devices 5 can be designed and operate in the ultraminiature low loss coaxial delay line 1. However, good results have been obtained by using an equalization amplifier or a gain stage amplifier with a high open loop gain. The equalization amplifier is useful because coaxial transmission line signal attenuation varies as a function of signal frequency. The equalization amplifier operates by altering the amplifier gain as the frequency of the input signal changes. Therefore, the gain of the amplifier varies to compensate for the coaxial transmission line signal attenuation that changes as a function of signal frequency. In this way, the delayed output signal which leaves the miniature coaxial cable assembly 2 can have the same characteristics as the non-delayed input signal that was supplied to the miniature coaxial cable assembly 2 even if the frequency of the nondelayed input signals provided to the delay line vary. By utilizing an equalization amplifier, less mechanical and electrical tuning of the delay line is required and the signal amplifying devices 5 do not have to be replaced or reprogrammed as the frequency of each non-delayed input signal changes. These signal amplifying devices can be produced utilizing current MMIC technology.

As shown in FIG. 1, each signal amplifying device 5 is also coupled to the power and control signal connector 9 so that each signal amplifying device 5 may be powered and controlled by an external circuit, such as a computer, to adjust its gain and frequency response in order to provide optimal system performance.

In the preferred embodiment of the present invention, each signal amplifying device 5 is mounted to the thin substrate supporting base plate 3 and located within an open area 10 defined by the concentric windings of the miniature coaxial cable assembly. Utilizing this configuration, a compact ultraminiature low loss coaxial delay line can be incorporated into almost any electronic system.

In the preferred embodiment of the present invention, more than one miniature coaxial cable assembly 2 and at least one signal switching device 6 is utilized. The signal switching device 6 is coupled to the output of a first miniature coaxial cable assembly and to the input of a second miniature coaxial cable assembly. Each signal switching device 6 is also coupled to an output switch 7 and to the power and control signal connector 9. The output switch 7 is coupled to an output signal connector 8 so that a time delayed signal produced by the ultraminiature low loss coaxial delay line 1 can be outputted.

Referring now to FIG. 2, shown are single pole, double throw switches 26 and 28 which correspond to signal switching devices 6 from FIG. 1. Also shown is a single pole, triple throw switch 27 which corresponds to output switch 7 from FIG. 1. Delay element 23 of FIG. 2 includes a signal amplifying device 20 coupled to approximately equal length portions of miniature coaxial cable 21 and 22.

Utilizing FIG. 2, the operation of the ultraminiature low loss coaxial delay line 1 will now be described. As a signal is introduced to delay element 23, it passes through miniature coaxial cable 21 which provides a signal delay. However, it is a characteristic of miniature coaxial cable to attenuate a signal as it proceeds through the coaxial cable. Therefore, a delayed and attenuated signal is provided from miniature coaxial cable 21. The delayed and attenuated signal is then provided to signal amplifying device 20 to compensate for the attenuation caused by the miniature coaxial cable 21. In addition to compensating for the attenuation caused by the miniature coaxial cable 21, the signal amplifying device 20 also amplifies the delayed and attenuated signal received from miniature coaxial cable 21 to compensate for attenuation which will be caused by miniature coaxial transmission cable 22. The signal amplifying device output signal is then directed to miniature coaxial cable 22 for additional time delay within delay element 23. But, any signal attenuation caused by miniature coaxial cable 22 has previously been compensated for by signal amplifying device 20. Therefore, the signal which is output from delay element 23 and provided to single pole, double throw switch 26 is substantially the same as the signal which was provided to the input of delay element 23.

The once delayed signal which leaves delay element 23 is provided to single pole, double throw switch 26. Depending upon the delay requirements of the electrical system, single pole, double throw switch 26 will route the once delayed signal to delay element 24 or to the single pole, triple throw output switch 27 for transferring the once delayed signal out of the ultraminiature low loss coaxial delay line. However, if additional delay time is required, single pole, double throw switch 26 will be positioned to provide the once delayed signal to delay element 24 for further time delay. Delay element 24 has the same configuration and operates in a manner similar to that of delay element 23. A twice delayed signal provided from delay element 24, which is substantially the same as the once delayed signal that was provided to delay element 24, is supplied to single pole, double throw switch 28. Single pole, double throw switch 28 will provide the twice delayed signal to output switch 27 if no further time delay is required. Otherwise, single pole, double throw switch 28 will provide the twice delayed signal to delay element 25 for additional signal time delay. Delay element 25 is constructed and operates in a manner similar to that of delay elements 23 and 24. As stated with regard to delay element 23 and 24, delay element 25 will output a thrice delayed signal which is substantially the same as the twice delayed signal which was provided to delay element 25 except that it has been additionally time delayed. As the thrice delayed signal exits delay element 25, output switch 27 is arranged to receive the thrice delayed signal and send the thrice delayed signal out of the ultraminiature low loss coaxial delay line and to another element of the electrical system. A suitable single pole, double throw switch which may be used is Part No. MA4SW200 which is a pin-diode switch made by MA/-COM Corporation. In addition Part No. MA4SW300, which is a suitable single pole, triple throw switch to be used with this invention, is also made by MA/COM Corporation.

It is possible to utilize the current invention in conjunction with a computer or processor to control the signal switching devices 6, output switch 7 and signal amplifying devices 5 so that the ultraminiature low noise coaxial delay line can automatically adjust the gain of the signal amplifying devices and change the routing of the electronic signal to vary the delay time. Specifically, a computer or processor can program and control the signal switching devices 6 and the output switch 7 to direct which combination of miniature coaxial cable assemblies 2 will be used to produce the required signal delay. For example, each single switching device 6 may be coupled to every miniature coaxial cable assembly so that an input signal could be transferred from one miniature coaxial cable assembly to any other miniature coaxial cable assembly. If each miniature coaxial cable assembly is produced with a different length of miniature coaxial transmission cable and has a corresponding different delay time, various combinations of individual miniature coaxial cable assemblies 2 can provide different total delay times. The total number of different delay times would correspond to the total number of different configurations of the miniature coaxial cable assemblies 2.

The signal amplifying devices 5 may also be controlled by a computer through the coupling of each signal amplifying device 5 to the power and control signal connector 9. Therefore, as the input signal frequencies and the frequency responses of the ultraminiature low loss coaxial delay line change, the signal amplifying devices 5 can change their gain characteristics accordingly.

The miniature coaxial cable may be produced with any commonly used conducting and dielectric materials or with recently developed superconducting material. If superconducting materials are used, then the need for signal amplifying devices is reduced because a superconducting coaxial cable has relatively little signal loss and attenuation.

Figure 3:
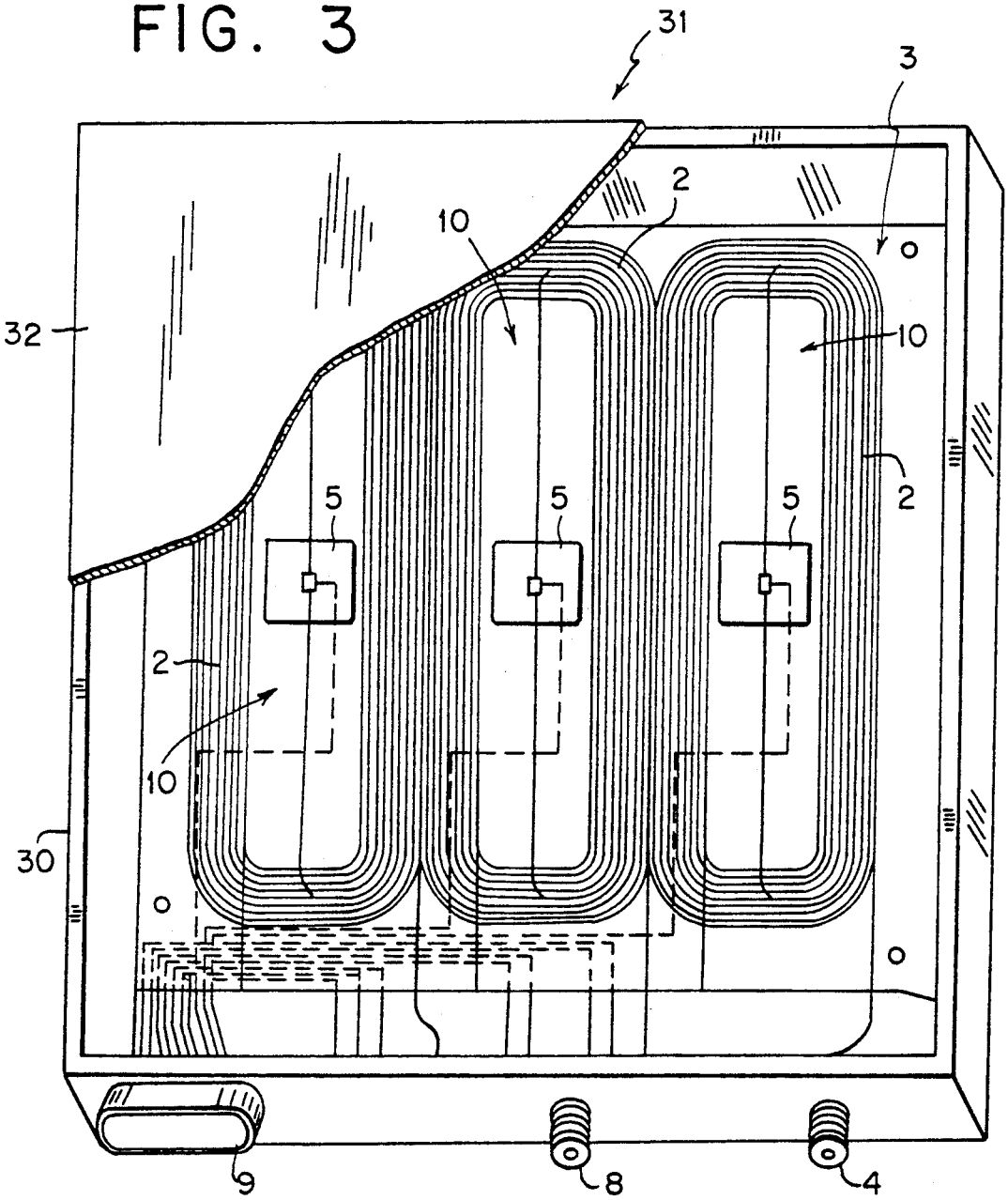
FIG. 3 is a perspective view of a preferred arrangement of the ultraminiature low loss coaxial delay line element shown in FIG. 1.

FIG. 3 shows a perspective view of one arrangement of an ultraminiature low loss coaxial delay line assembly 3 of the present invention. Reference numeral 30 generally designates a protective housing in which is mounted the thin substrate supporting base plate as well as all of the components mounted on the base plate. The protective housing 30 shields the concentrically wound miniature coaxial cable assemblies 2, the signal amplifying devices 5 and the other components. The protective housing 30 includes a cove 32 that covers the entire assembly, including signal switching devices 6 (not shown), the output switch 7 (not shown), the coaxial cable windings and the signal amplifying devices. The protective housing 30 also has sidewalls on which are mounted the input signal connector 4, the output signal connector 8 and the power and control signal connector 9. The protective housing provides protection of the delay line components from detrimental environmental conditions including electrical signal interference.

As mentioned previously, each of the coaxial cable assemblies may have a different number of windings and a different length of coaxial cable to provide different delays. For example, the first coaxial cable assembly may provide a 10 nanosecond delay, the second coaxial cable assembly may provide a 20 nanosecond delay, and the third coaxial cable assembly may provide a 40 nanosecond delay. The first switching device may include an additional pole which may be connected to the wiper of the second switching device so that the output signal from the first coaxial cable assembly may bypass the second coaxial assembly and be provided directly to the third coaxial assembly. The switching devices are controlled by the control signal so that the delay line may provide numerous, selectable delay times to a signal provided to it.

Figure 4:
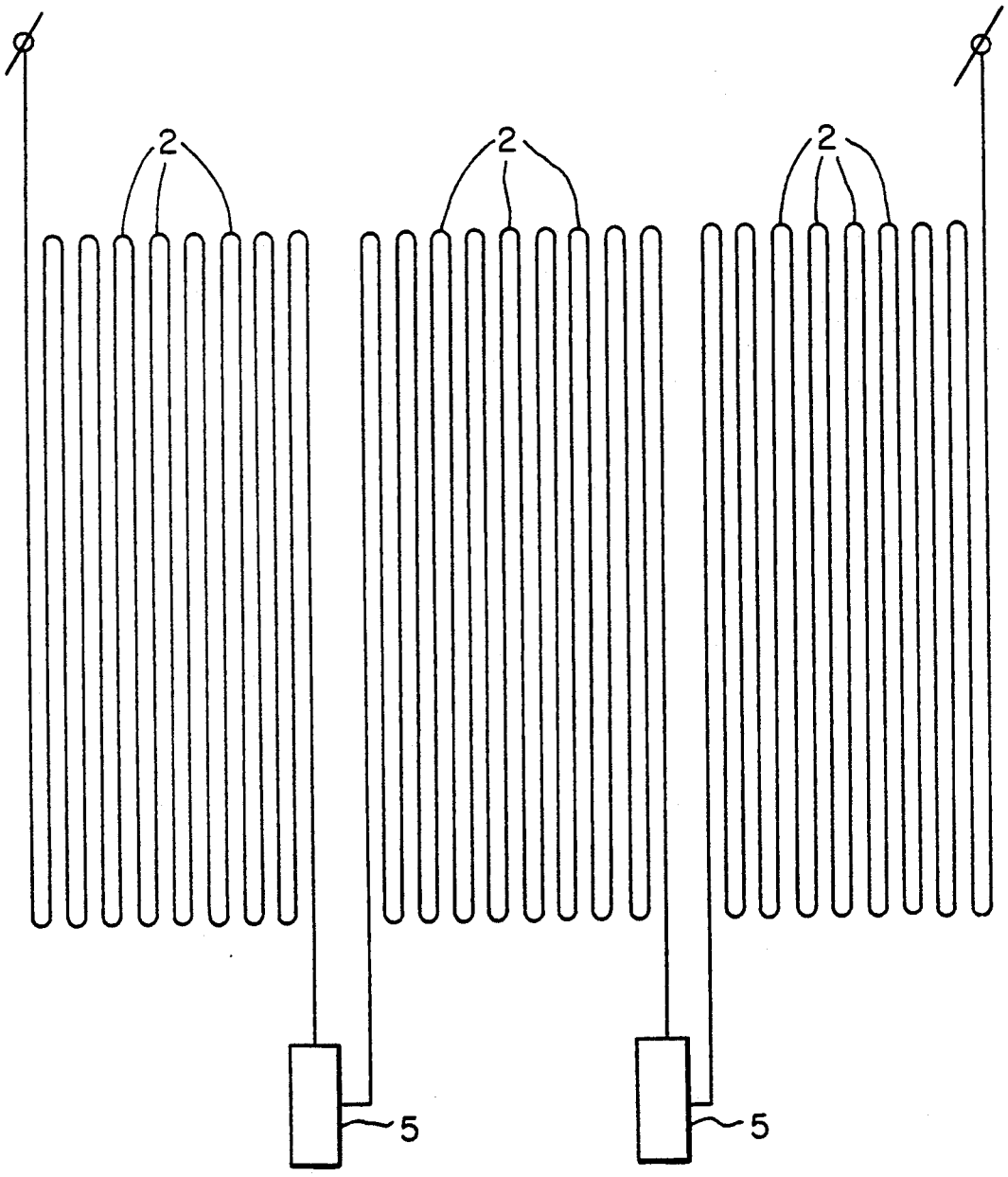
FIG. 4 is a block diagram of an alternative configuration of coaxial cable windings used in the present invention.

FIGS. 1-3 show the coaxial cable assemblies as being formed by concentrically winding the coaxial cable about itself. However, it is envisioned to be within the scope of the invention to lay out the windings in other configurations, such as the serpentine windings shown in FIG. 4, and having the amplifier mounted on the substrate situated outside the region of the windings. The serpentine windings of FIG. 4 have amplifiers coupled to coaxial cable after a number of windings.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An ultraminiature low loss coaxial delay line comprising:

a supporting base plate;

a miniature coaxial cable assembly utilizing miniature coaxial cable, the miniature coaxial cable assembly having an input and an output, the miniature coaxial cable being closely wound around a previously wound portion of the miniature coaxial cable to form a plurality of windings, each winding of the miniature coaxial cable assembly being flatly mounted on the supporting base plate; and a signal amplifying device compensating for electronic signal attenuation caused by the miniature coaxial cable of the miniature coaxial cable assembly, the signal amplifying device being electrically coupled to the length of miniature coaxial cable of the miniature coaxial cable assembly, the signal amplifying device receiving a miniature coaxial cable signal as an input signal and providing a signal amplifying device output signal, the amplifying device being electrically coupled to the approximate midpoint of the length of miniature coaxial cable.

2. An ultraminiature low loss microwave delay line as defined by claim 1, wherein the plurality of windings of the miniature coaxial cable defines an open area on the surface of the supporting base plate contained within boundaries of the windings, and wherein the signal amplifying device is mounted in the open area on the surface of the supporting base plate to provide a space saving arrangement.

3. An ultraminiature low loss coaxial delay line for producing a known controlled time delay to be introduced to an electrical signal generated and processed in connection with an electrical system, the ultraminiature low loss coaxial delay line comprising:

a signal input and a signal output;

a supporting base plate;

at least a first and a second miniature coaxial cable assembly utilizing miniature coaxial cable, the first and second miniature cable assembly each having an input and an output, the input of the first coaxial cable assembly being coupled to the signal input of the delay line, each of the first and second miniature coaxial cable assemblies being formed by successively winding the miniature coaxial cable concentrically around a previously wound portion of the coaxial cable to thereby form a plurality of concentric windings, each concentric winding of the first and second miniature coaxial cable assembly being flatly mounted on the supporting base plate;

at least a first and a second signal amplifying device for compensating for electronic signal attenuation caused by a corresponding miniature coaxial cable assembly, each of the first and second signal amplifying devices being electrically coupled to the approximate midpoint of a length of miniature coaxial cable of a corresponding miniature coaxial cable assembly, each of the first and second signal amplifying devices receiving a miniature coaxial cable signal as an input signal and providing a signal amplifying device output signal; and at least a first signal switching device, the first signal switching device being coupled to the output of the first miniature coaxial cable assembly and to the input of the second miniature coaxial cable assembly, the signal switching device receiving a control signal and providing the output signal from the first miniature coaxial cable assembly to one of the second miniature coaxial cable assembly and the delay line signal output in response to the control signal.

4. An ultraminiature low loss coaxial delay line in accordance with claim 3, wherein at least the first signal switching device is programmable.

5. An ultraminiature low loss coaxial delay line in accordance with claim 1, wherein the miniature coaxial cable assembly utilizes miniature coaxial cable that is composed of superconducting material.

6. An ultraminiature low loss coaxial delay line in accordance with claim 1, wherein the signal amplifying device has a programmable gain.

7. An ultraminiature low loss coaxial delay line in accordance with claim 1, wherein the supporting base plate is formed from a flexible thin substrate.

8. An ultraminiature low loss coaxial delay line assembly comprising:

a supporting base plate;

first, second and third concentrically wound miniature coaxial cable assemblies each having an input and an output, each concentrically wound miniature coaxial cable assembly being flatly mounted on the supporting base plate, each concentrically wound miniature coaxial cable assembly utilizing miniature coaxial cable;

three signal amplifying devices for compensating for an electronic signal attenuation caused by a corresponding concentrically wound miniature coaxial cable assembly, each signal amplifying device being electrically coupled to an approximate midpoint of a length of a corresponding miniature coaxial cable of the corresponding miniature cable coaxial assembly, each signal amplifying device being mounted onto the supporting base plate and within an open area defined by the corresponding concentrically wound miniature coaxial cable assembly;

first and second signal switching devices, the first signal switching device being coupled to the first concentrically wound miniature coaxial cable assembly and to the second concentrically wound miniature coaxial cable assembly, the first signal switching device being further coupled to an output switch, the second signal switching device being coupled to the second concentrically wound miniature coaxial cable assembly and to a third concentrically wound miniature coaxial cable assembly, the second signal switching device being further coupled to the output switch, each signal switching device also being coupled to a power and computer adaptor connector for programming the signal switching devices;

an output switch, the output switch being coupled to the first signal switching device and the second signal switching device, the output switch being further coupled to an output signal connector for providing an ultraminiature low loss coaxial delay line output signal, the output switch being further coupled to the power and control signal connector for programming the output switch;

a protective housing, the protective housing having sidewalls and a cover secured to the sidewalls, the concentrically wound miniature coaxial cable assemblies, the signal amplifying devices, the signal switching devices and the output switch being mounted in the protective housing;

an input signal connector mounted on the protective housing for receiving an electrical signal to be time delayed;

an output signal connector mounted on the protective housing for providing an electrical signal which has been time delayed; and a power and control signal connector mounted on the protective housing for electrically coupling the ultraminiature low loss coaxial delay line assembly to a control device, the control device operating to program and manipulate the electrical signal time delay generated by the ultraminiature low loss coaxial delay line assembly and the gain of the signal amplifying devices.

* * * * *